US005657871A

United States Patent [19]

Waters et al.

[11] Patent Number: 5,657,871

[45] Date of Patent: Aug. 19, 1997

[54] CONTAINER WITH A STACKING RING

[75] Inventors: Robert E. Waters, Inman; Larry D. Wyatt, Cowpens, both of S.C.

[73] Assignee: Spartanburg Steel Products, Inc., Spartanburg, S.C.

[21] Appl. No.: 584,238

[22] Filed: Jan. 11, 1996

[51] Int. Cl.[6] ..... B65D 21/032

[52] U.S. Cl. ..... 206/509; 220/636; 220/632; 220/630

[58] Field of Search ..... 220/630, 632, 220/633, 634, 636, DIG. 1; 206/821, 503, 509

[56] References Cited

U.S. PATENT DOCUMENTS

| | | | |
|---|---|---|---|
| D. 327,604 | 7/1992 | Culverson | D7/387 |
| D. 331,349 | 12/1992 | Culverson | D7/387 |
| 2,060,942 | 11/1936 | Kline et al. | 220/DIG. 1 |
| 2,103,677 | 12/1937 | Kline et al. | 220/DIG. 1 |
| 2,119,745 | 6/1938 | Ingersoll | 220/97 |
| 2,957,601 | 10/1960 | Novick | 220/97 |
| 3,143,243 | 8/1964 | MacKusick | 220/632 |
| 4,573,603 | 3/1986 | Starling | 220/5 R |
| 4,625,881 | 12/1986 | Carlson | 220/632 |
| 5,199,570 | 4/1993 | McKenzie | 206/503 |
| 5,249,684 | 10/1993 | Sterett | 206/503 |

FOREIGN PATENT DOCUMENTS

| | | | |
|---|---|---|---|
| 614817 | 9/1994 | European Pat. Off. | 220/632 |
| 1411837 | 8/1965 | France | 220/632 |
| 617702 | 8/1935 | Germany | 220/632 |
| 2733126 | 2/1979 | Germany | 220/632 |
| 602264 | 5/1948 | United Kingdom | 220/632 |

OTHER PUBLICATIONS

"Supreme technology—Stainless steel kegs", Thielmann Container Systeme GmbH, advertising brochure, 13 pages, (undated).

*Primary Examiner*—Stephen J. Castellano

*Attorney, Agent, or Firm*—Renner, Kenner, Greive, Bobak, Taylor & Weber

[57] ABSTRACT

A container (11), such as a beer keg or the like, includes a metallic top surface (14) and a metallic bottom surface (17) with metallic cylindrical sidewalls (15,18) extending therebetween. A metallic cylindrical top skirt (20) extends upwardly from and surrounds the top surface (14) while a metallic cylindrical bottom skirt (21) extends downwardly from and surrounds the bottom surface (17). An elastomeric ring (10) is positioned between the bottom surface (17) and the bottom skirt (21) and includes an annular foot (33) which extends downwardly below the bottom skirt (21). The foot (33) is thus adapted to rest on the ground and the ring (10) absorbs the shock of a drop to thereby protect the container (11) from damage. An outer diameter of the foot (33) is adapted to fit within the inner diameter of the top skirt (20) so that the container (11) may be stacked on a like container (11A).

9 Claims, 3 Drawing Sheets

CONTAINER WITH A STACKING RING

TECHNICAL FIELD

This invention relates to a container, particularly of the reusable type, for holding beverages such as beer, soda or the like. More particularly, this invention relates to such a container, usually made out of stainless steel, which is provided with an elastomeric shock absorbing and stacking ring which not only protects the container if dropped, but also enables the container to be conveniently stacked upon a like container.

BACKGROUND ART

The beverage industry often utilizes reusable and refillable cylindrical containers to hold, and oftentimes dispense, its contents. Typical of such containers is the conventional beer keg which is traditionally made out of stainless steel. Such containers are usually filled with new contents at the site of the bottling or brewing company, loaded onto trucks and taken to their retail destination where the driver will normally pick up empty containers to be taken back to the beverage company for cleaning and refilling.

As such, it is convenient, if not mandatory, that the cylindrical containers are able to stack onto each other for economical shipment of the greatest number of containers in the smallest amount of space. To that end, the cylindrical containers must be modified to make them stackable. Usually this is accomplished by modifying the diameter of the conventional skirt at the bottom of a container so that it fits over the diameter of the top skirt of a like container below.

Ideally, the container manufacturer prefers to make the skirts for these customers out of high strength stainless steel so that if a container is dropped, or thrown from a truck for example, the skirt will not break or otherwise bend or deform. However, high strength stainless steel is not susceptible to being expanded or elongated to create enough offset for the bottom skirt to fit over the top skirt of a container positioned below. Attempts to so expand the high strength material only results in the cracking or splitting thereof. As a result, most container manufacturers make their skirts out of a softer stainless steel so that they can be appropriately deformed for stacking. Now, however, these skirts are quite susceptible to further deformation upon being dropped and eventually they will become so deformed that they will no longer stack onto like containers.

Another attempt to solve the problem is shown in U.S. Pat. No. 4,573,603. There, the conventional upper and lower stainless steel skirts are eliminated and replaced by a specifically configured collar fastened to the top of the container shell and a specifically configured foot ring fastened to the bottom of the container shell. While these containers may thus be stacked, eliminating the conventional stainless steel skirts detracts from the overall strength of the container. Moreover, such a system requires the manufacture of two items, the upper collar and the lower foot ring, of different configurations, and cannot be used with the multitude of existing and newly conventional stainless steel containers.

The need exists, therefore, for a container having skirts constructed out of high strength stainless steel, for durability, which can readily be configured to stack, with stability, onto a like container.

DISCLOSURE OF THE INVENTION

It is thus our object of the present invention to provide a generally cylindrical container which is stackable on top of a like container.

It is another object of the present invention to provide a container, as above, having skirts which can be constructed of a high strength stainless steel and be used for holding liquid beverages.

It is an additional object of the present invention to provide a container, as above, with an elastomeric stacking ring having a configuration so that it may be fitted into the bottom of a container and which is also configured so that it will fit within the diameter of the upper skirt of a like container positioned below.

It is a further object of the present invention to provide a container, as above, in which the stacking ring is positioned between the domed bottom end shell and the bottom skirt of the container to cushion the blow of the container being dropped on its bottom skirt.

These and other objects of the present invention, as well as the advantages over existing prior art forms, which will become apparent from the description to follow, are accomplished by the invention hereinafter described and claimed.

In general, a container made in accordance with the concept of the present invention includes metallic top and bottom surfaces with a metallic cylindrical sidewall extending therebetween. A cylindrical bottom skirt extends downwardly from and surrounds the bottom surface, while a cylindrical top skirt extends upwardly from and surrounds the top surface. An annular elastomeric ring is positionable between the bottom surface and the bottom skirt and has an annular foot extending downwardly to a point below the bottom skirt. An outer diameter of the foot is adapted to fit within the inner diameter of the top skirt of a like container so that the container may be stacked upon the like container.

A preferred exemplary container incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
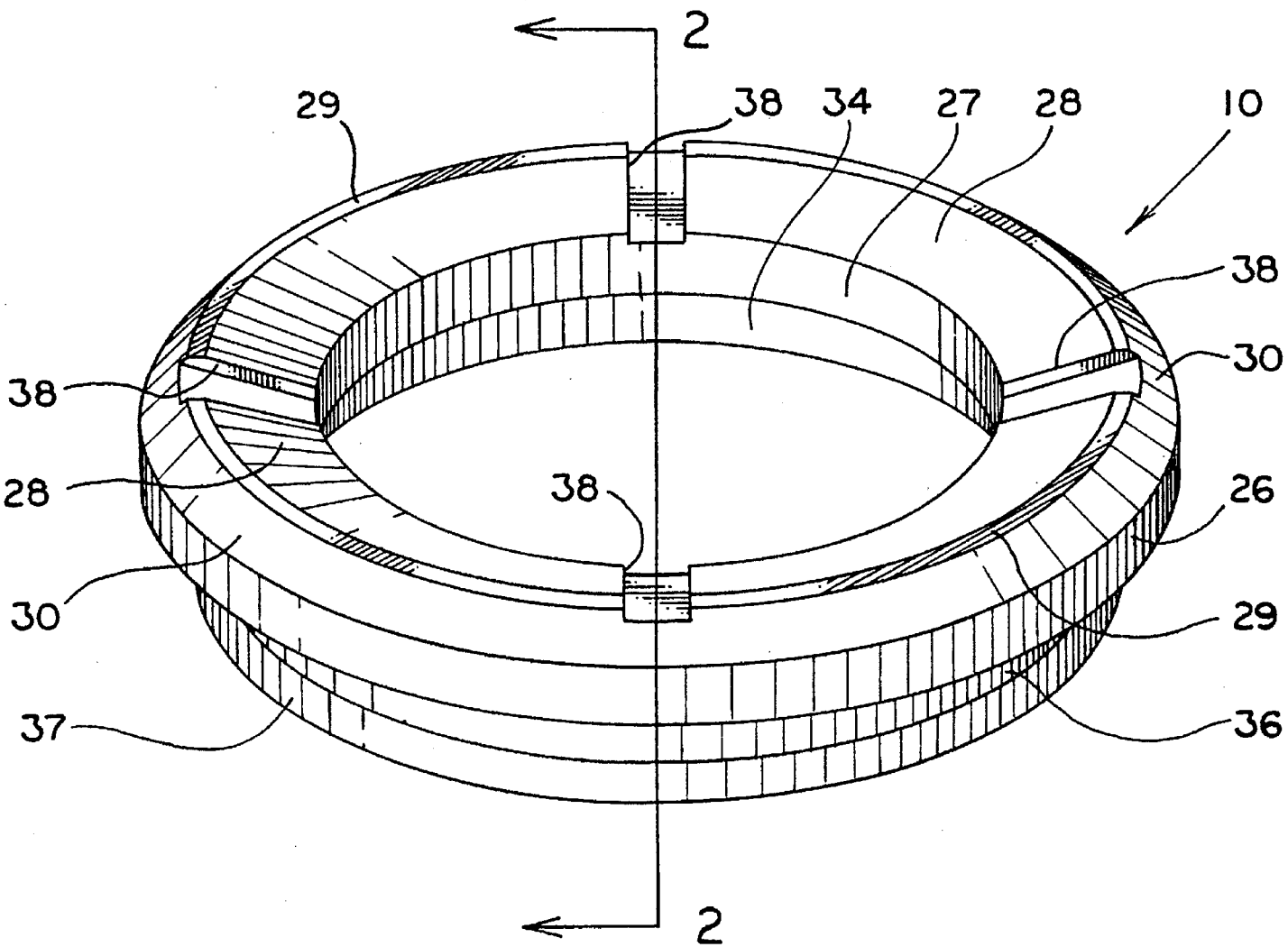
FIG. 1 is a perspective view of a stacking ring for a container made in accordance with the concept of the present invention.
Figure 2:
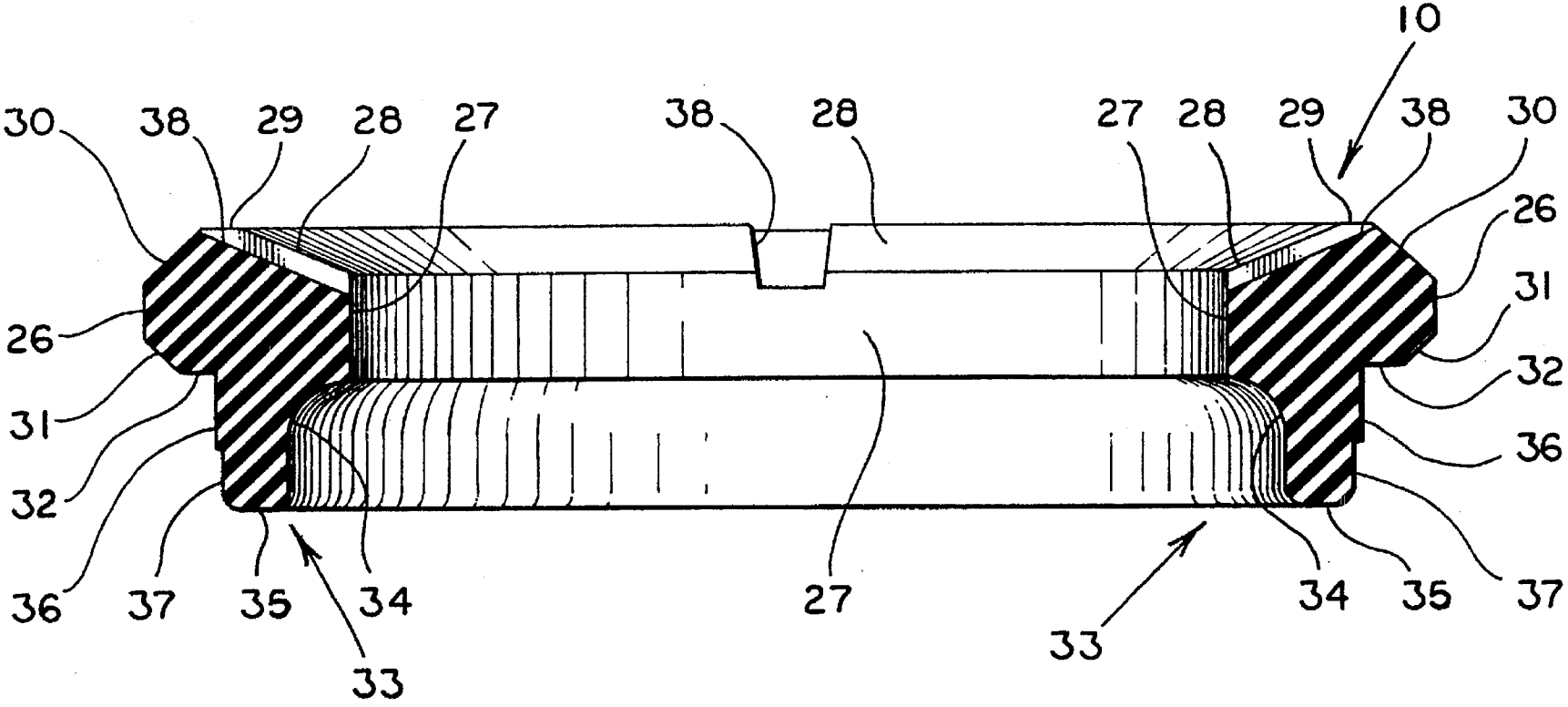
FIG. 2 is a sectional view taken substantially along line 2—2 of FIG. 1.

A stacking ring made in accordance with the present invention is indicated generally by the numeral 10 and is adapted to be used with or be part of a container, generally indicated by the numeral 11, so that container 11 can stack upon a like container, generally indicated by the numeral 11A. As will also hereinafter become evident, ring 10 also protects container 11 from damage should it be dropped.

Container 11 is shown in the form of a conventional, and otherwise popular, beer or other beverage-holding keg and includes an upper shell, generally indicated by the numeral 12, and a lower shell, generally indicated by the numeral 13. Upper shell 12 includes a generally domed top surface 14 with a cylindrical sidewall 15 extending downwardly therefrom. Top surface 14 is provided with a bunghole 16 for filling, and/or removing contents from, container 11. Lower shell 13 includes a generally domed bottom surface 17 with a cylindrical sidewall 18 extending upwardly therefrom. Shells 12 and 13 are most efficiently separately formed and are attached, to form the enclosed container 11, by aligning the lower edge of sidewall 15 with sidewall 18 and welding upper shell 12 to lower shell 13. A flat surface 19 may be formed generally centrally of domed bottom surface 17, and being the lowest surface of container 11, surface 19 acts as a sump from which the contents of container 11 are drawn. Shells 12 and 13 are preferably formed of a standard stainless steel having relatively high elongation characteristics for deep drawing requirements.

Container 11 also includes an upper annular skirt, generally indicated by the numeral 20, and a lower annular skirt, generally indicated by the numeral 21. Upper skirt 20 includes a cylindrical sidewall 22 which extends upwardly from and surrounds top surface 14 and which may be attached to top surface 14 at or near its junction with sidewall 15, as by welding. An annular curled bead 23 is formed at the upper end of sidewall 22 and extends above bunghole 16 to protect the same. Lower annular skirt 21 includes a cylindrical sidewall 24 which extends downwardly from and surrounds bottom surface 17 and which may be attached to bottom surface 17 at or near its junction with sidewall 18, as by welding. An annular curled bead 25 is formed at the lower end of sidewall 24 and extends below sump surface 19. Such curl beads 23 and 25 not only provide strength to skirts 20 and 21, respectively, but also upper bead 23 can be utilized as support for handles for carrying container 11 formed by providing opposed apertures (not shown) in upper skirt sidewall 22. Skirts 20 and 21 may be made of a high strength stainless steel, or other equivalent metallic material.

Figure 3:
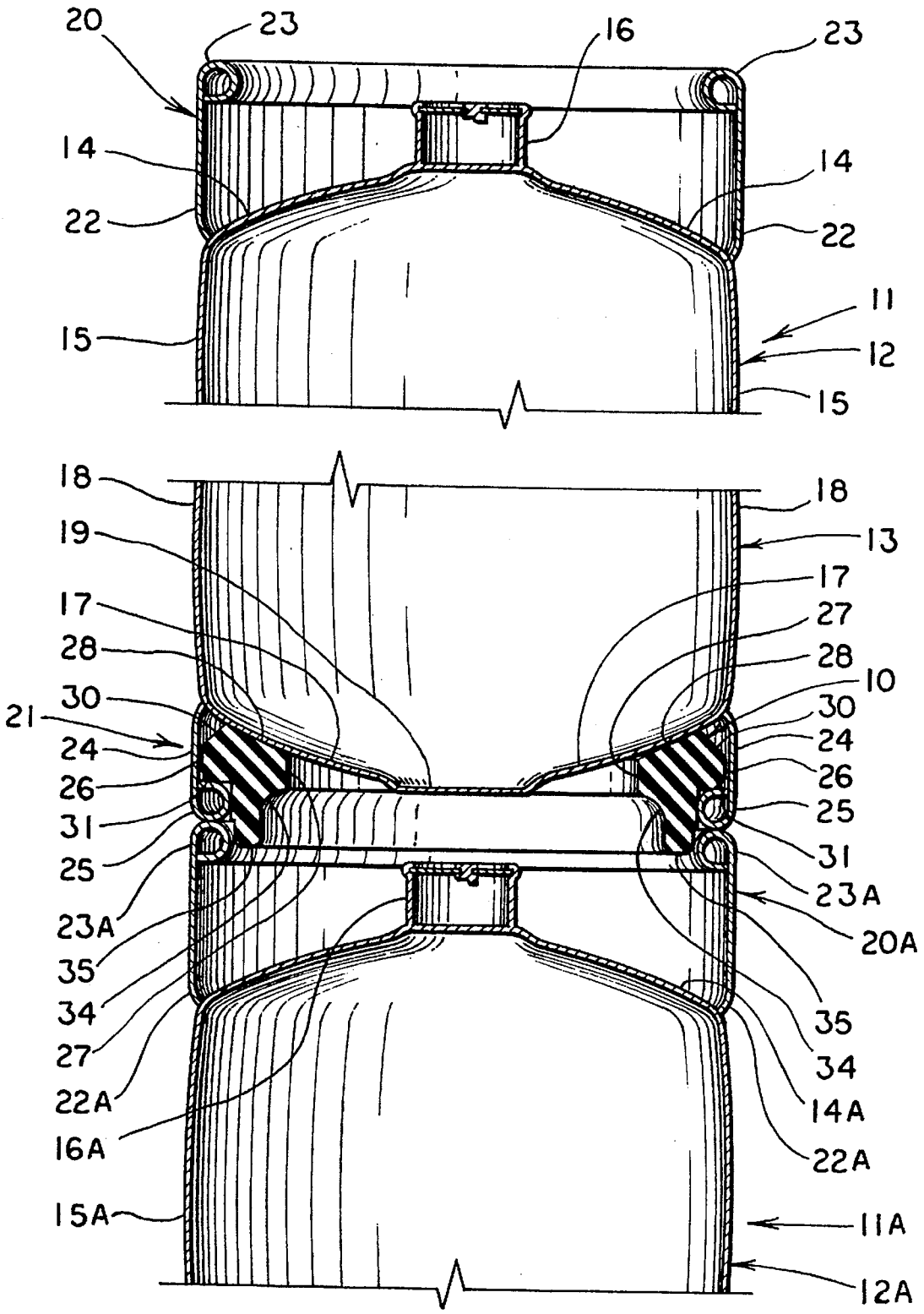
FIG. 3 is a fragmented sectional view showing the stacking ring fitted within the container and showing the manner in which the stacking ring is utilized to enable conventional containers to be stacked.

The container 11 just described is a conventional item which normally, but for stacking ring 10, would have utilized bead 25 as its foot when resting on a surface. However, as is prevalent with these containers, bead 25 and skirt 21 are often damaged, cracked, or bent if container 11 is dropped. Moreover, with skirts made of high strength stainless steel, it is impractical to attempt to stack container 11 on a like container 11A which has identical components as container 11, those of which are shown in FIG. 3 having been given identical reference numerals followed by the suffix A. Stacking ring 10 solves the damage and stacking problems and will now be described in detail.

Ring 10 is preferably made of an elastomeric material, such as 60 durometer ethylene propylene diamine, and is annular in configuration, including a generally vertically oriented outer surface 26, defining the outermost diameter of ring 10 and a generally vertically oriented inner surface 27 defining the innermost diameter of ring 10. A dome bearing surface 28 extends upwardly from the top edge of inner surface 27. Although surface 28 could be relatively planar, it is preferably slightly arcuate in nature corresponding to the generally spherical shape of domed bottom surface 17 of container 11. A generally flat top surface 29 extends generally horizontally radially outward from the top of bearing surface 28. A bevelled surface 30 extends between the radially outer edge of top surface 29 and the upper edge of outer surface 26. Surface 30 need not be bevelled but could, in actuality, be a generally vertical continuation of surface 26. However, to save material to reduce manufacturing costs and for the ease of insertion of ring 10 into container 11, as will be hereinafter described, the bevelled surface 30 is preferred. Moreover, flat top surface 29 is not essential and could be eliminated merely by having bearing surface 28 intersect bevelled surface 30 at a point, as shown in FIG. 3. However, a flat top surface is preferred as it provides a transition area, for ease of manufacture, between surfaces 28 and 30.

A bevelled surface 31 extends diagonally radially inwardly from the bottom of outer surface 26 and terminates at a generally horizontal bead bearing surface 32 which extends generally radially inwardly from the bottom of surface 31. Just like bevelled surface 30, surface 31 need not be bevelled, but such is preferred for the economic manufacture and ease of use of ring 10. An annular foot, generally indicated by the numeral 33, is formed at the bottom of ring 10. Foot 33 is formed on one side by an inner surface 34 extending downwardly from the bottom of inner surface 27, terminating at a flat bottom 35. A vertical surface having steps 36 and 37 defines the radially outer edge of foot 33. Stepped surface 36 and 37 extend downwardly from bead bearing surface 32 to flat bottom 35.

Ring 10 may be inserted into container 11 by grasping opposed areas of feet 33 and pulling them away from each other so that ring 10 will flex sufficiently such that it can be snapped into position, as shown in FIG. 3, between lower skirt 21 and domed bottom surface 17. As such, dome bearing surface 28 is engaging bottom surface 17 and bead bearing surface 32 is engaging curled bead 25 with an opposed force to maintain ring 10 in container 11. Vertical step surface 36 of foot 33 is adapted to be slip fit within curled bead 25, and thus, the outer diameter of surface 36 should be slightly smaller than the inner diameter of bead 25. Bead 25 is thus locked between surfaces 32 and 36. It should also be noted that outer surface 26 of ring 10 is slightly spaced from sidewall 24 of skirt 21 when ring 10 is positioned in container 11. Such is to accommodate sizing tolerances or any shifting of ring 10 within skirt 21.

With ring 10 installed in container 11, as just described, container 11 may be freestanding on foot 33 which extends below bottom skirt 21. Moreover, ring 10 also represents an anti-skid mechanism for ease in handling the containers. If container 11 is dropped, rather than bead 25 adversely absorbing the force, feet 33 and ring 10 will cushion the blow. In addition, because dome bearing surface 28 bears against a substantial portion of domed bottom surface 17, that is, approximately one-third thereof, and because it preferably takes on the spherical shape of surface 17, as previously described, bearing surface 28 will maintain surface 17 in its generally spherical shape despite the force of the drop; that is, domed bottom surface 17 will not be dented as bearing surface 28 spreads the force evenly thereto.

In the event that a container 11 having a ring 10 therein is stored in an inverted or upside down condition, liquid could undesirable be trapped or otherwise accumulate on domed surface 17 within inner annular surface 27 of ring 10. To avoid this potential problem, a plurality (preferably four) slots 38 may be formed in bearing surface 28. Slots 38 can extend into surface 27 and through to surface 30 so that any such liquid will pass therethrough and into area 39 between ring 10 and lower skirt 21. In turn, lower skirt 21 may be provided with conventional drainage apertures (not shown) to permit passage of the liquid from area 39.

As shown in FIG. 3, ring 10 also enables container 11 to be stacked on a like container 11A. As such, bead 25 of lower skirt 21 of container 11 may rest on bead 23A of upper skirt 20A of like container 11A. Container 11 is maintained stably positioned and centered on container 11A by foot 33. Specifically, the outer diameter of stepped surface 37 of foot 33 extends within bead 23A but is slightly smaller than the inner diameter of bead 23A. Thus, container 11 can be easily positioned on container 11A, without interference between surface 37 and bead 23A, and yet the two are maintained aligned with a slight shifting of container 11 with respect to like container 11A being accommodated.

It should thus be evident that a container fitted with a stacking ring made in accordance with the concept of the present invention, as described above, accomplishes the objects of the present invention and otherwise substantially improves the art.

We claim:

1. A container comprising a metallic top surface, a metallic bottom surface, and a metallic cylindrical sidewall extending between said top surface and said bottom surface; a cylindrical bottom skirt extending downwardly from and surrounding said bottom surface; a cylindrical top skirt extending upwardly from and surrounding said top surface; and an annular elastomeric ring positionable between said bottom surface and said bottom skirt, said ring including an outer surface defining the outer diameter of said ring, said outer surface being spaced slightly from said skirt, said ring having an annular foot extending downwardly to a point below said bottom skirt, a diameter of said foot being adapted to fit within the inner diameter of the top skirt of a like container so that the container may be stacked upon the like container.

2. A container according to claim 1 wherein said ring includes a bearing surface engaging a portion of said bottom surface.

3. A container according to claim 2 wherein said bottom surface is arcuate in configuration and said bearing surface is correspondingly arcuate.

4. A container according to claim 2 further comprising a bead formed on the lower end of said bottom skirt, and wherein said ring includes a second bearing surface engaging said bead.

5. A container according to claim 4 wherein said bead defines the inner diameter of said bottom skirt and wherein said foot includes a second diameter received within said bead.

6. A container comprising a metallic top surface, a metallic bottom surface, and a metallic cylindrical sidewall extending between said top surface and said bottom surface; a cylindrical bottom skirt extending downwardly from and surrounding said bottom surface; a bead formed on the lower end of said bottom skirt; a cylindrical top skirt extending upwardly from and surrounding said top surface; and an annular elastomeric ring positionable between said bottom surface and said bottom skirt, said ring having a first bearing surface engaging a portion of said bottom surface, a second bearing surface engaging said bead, an outer surface defining the outer diameter of said ring, said outer surface being spaced slightly from said skirt, and an annular foot extending downwardly to a point below said bottom skirt; said foot having a surface received within said bead and having a diameter adapted to fit within the inner diameter of the top skirt of a like container so that the container may be stacked upon the like container.

7. A container according to claim 6 further comprising a bead formed on the upper end of said top skirt and defining the inner diameter of said top skirt, said diameter of said foot being slightly less than said inner diameter of said top skirt.

8. A container according to claim 6 wherein said surface of said foot has an outer diameter greater than said diameter of said foot.

9. A container according to claim 6 wherein said bottom surface is arcuate in configuration and said first bearing surface is correspondingly arcuate.

* * * * *